United States Patent [19]

Barrett

[11] Patent Number: 4,790,289

[45] Date of Patent: Dec. 13, 1988

[54] SEDIMENT AGITATING APPARATUS FOR WATER HEATER

[75] Inventor: Fred E. Barrett, Columbia, S.C.

[73] Assignee: A. O. Smith Corporation, Milwaukee, Wis.

[21] Appl. No.: 122,756

[22] Filed: Nov. 19, 1987

Related U.S. Application Data

[63] Continuation-in-part of Ser. No. 047,662, May 7, 1987.

[51] Int. Cl.[4] ..... F24H 1/00

[52] U.S. Cl. ..... 126/362; 126/344; 122/380; 122/390; 137/563; 219/297

[58] Field of Search ..... 126/362, 361, 344, 350 R; 122/159, 380, 379, 383, 384, 390, 396, 402, 405, 382, 388, 20 A, 20 B, 17; 219/297, 310; 165/108, 109.1, 132; 137/268, 563, 565, 238

[56] References Cited

U.S. PATENT DOCUMENTS

| | | | |
|---|---|---|---|
| 2,600,521 | 6/1952 | Swisher | 126/362 X |
| 2,652,358 | 9/1953 | McFerran | 126/362 X |
| 3,499,423 | 3/1970 | Phlaum | 126/362 X |
| 4,385,723 | 5/1983 | Sanborn et al. | 126/351 X |
| 4,505,231 | 3/1985 | Syler | 122/383 X |
| 4,714,053 | 12/1987 | Perry | 122/390 X |

*Primary Examiner*—Randall L. Green

*Attorney, Agent, or Firm*—Andrus, Sceales, Starke & Sawall

[57] ABSTRACT

An agitating mechanism to aid in preventing the buildup of sediment in a gas fired water heater. The agitating mechanism includes a pump located outside of the tank and a first conduit connects the inlet of the pump to the interior of the tank, while a second conduit connects the discharge side of the pump to the lower end of the tank. Operation of the pump will withdraw water from the tank and discharge the water back into the tank adjacent the lower head to help provide agitation and prevent the buildup of sediment. The conduits, as well as the pump, can be mounted on a cleanout panel which encloses a cleanout opening in the lower end of the tank.

5 Claims, 2 Drawing Sheets

FIG. 4
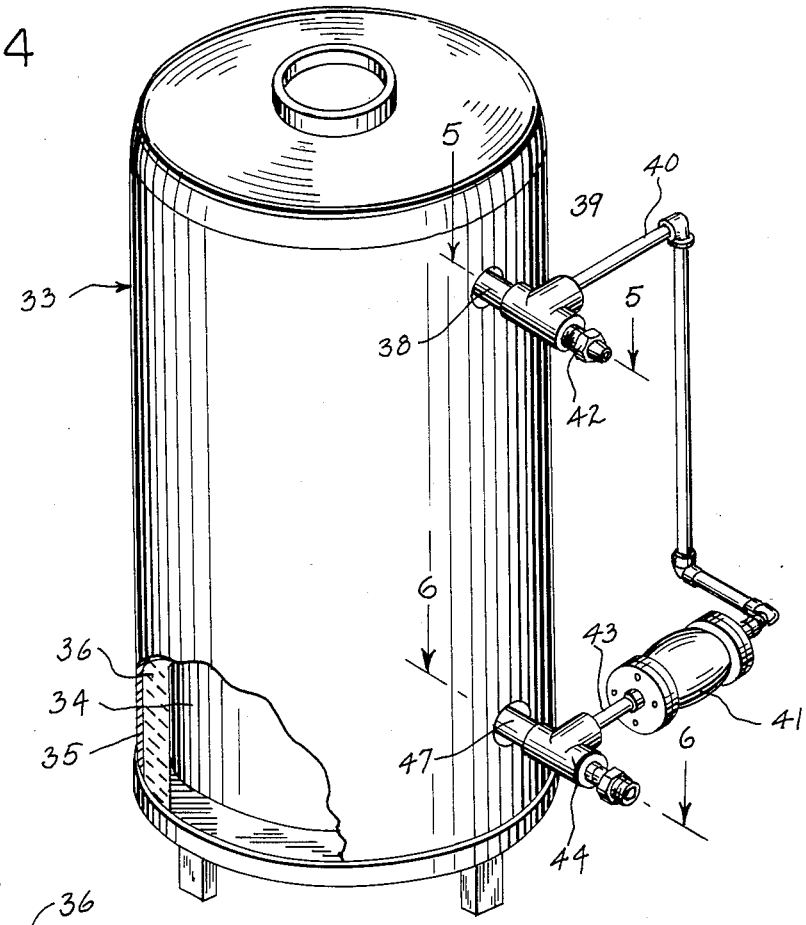
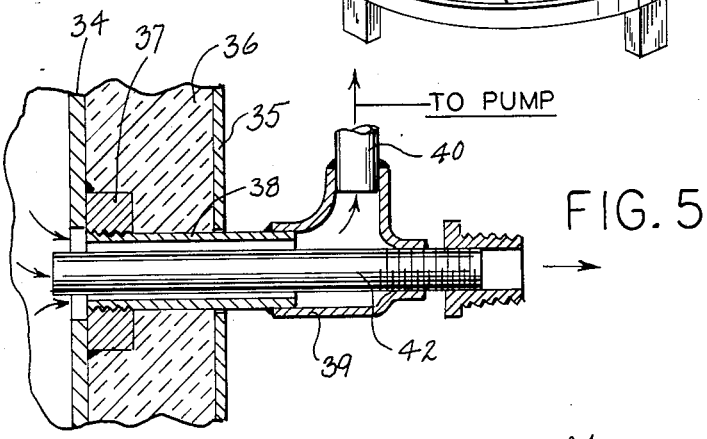
FIG. 5
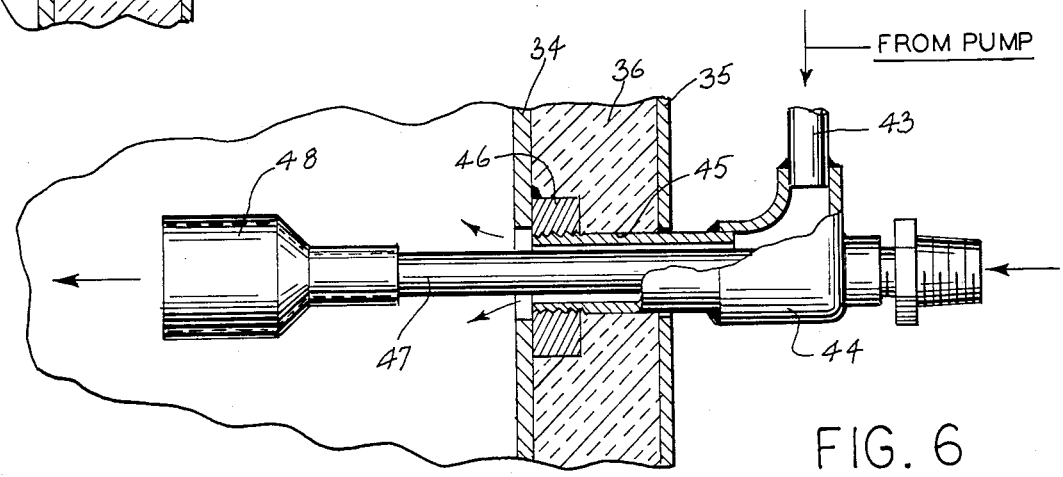
FIG. 6

SEDIMENT AGITATING APPARATUS FOR WATER HEATER

This application is a continuation-in-part of application Ser. No. 07/047,662, filed May 7, 1987.

BACKGROUND OF THE INVENTION

In certain localities where water contains a high mineral content, sediment or lime can build up in a water heater tank. With a gas fired water heater, the gas burner is located generally in a compartment beneath the lower head, and the buildup of sediment on the lower head acts as an insulating layer to reduce the rate of heat transfer from the burner to the water in the tank. As the insulating layer increases in thickness, overheating of the lower head can result, which can, in some instances, result in rupture of the head.

To aid in preventing the buildup of sediment on the lower head of a gas fired water heater, agitator systems have been incorporated to agitate the water in the lower end of the tank. In a conventional water heater, as a faucet is opened in the water piping system, heated water will be drawn from the water heater and cold water will be introduced into the lower portion of the water heater tank. In the agitation systems as used in the past, the entry of the cold water has been employed to create the agitating action to prevent buildup of sediment, as dislosed in U.S. Pat. Nos. 4,257,355 and 4,157,077.

The commercially available agitation systems are intended to disperse existing scale on the lower head of the tank, and it is apparent that a better approach would be to prevent or minimize the formation of scale. One manner of minimizing the formation of scale would be to reduce the temperature of the heat transfer surface, i.e. the lower head of the tank.

Furthermore, the existing agitating systems perform the agitation function only during periods of water demand. Therefore, there is no agitation of the scale during periods when water is not being drawn from the tank, and it would clearly be a better practice to provide water circulation and cooling of the lower head during all burner operating periods.

SUMMARY OF THE INVENTION

The invention is directed to an improved agitation system for a water heater, which will help prevent the buildup of sediment or lime on the lower head of the tank. In accordance with the invention, a water circulation system is incorporated, with the tank. The circulation system includes a pump located outside of the tank and a first conduit provides communication between the inlet side of the pump and the interior of the tank, while a second conduit connects the outlet side of the pump to the tank. Operation of the pump will draw water from the tank and discharge the water into the lower end of the tank adjacent the lower head to aid in preventing buildup of lime in that area.

In one form of the invention, the two conduits of the circulating system extend through separate openings in the tank wall, while in another form of the invention the two conduits are in concentric relation and extend through a single opening in the tank wall.

It is contemplated that the circulation system can be incorporated with the panel that encloses the cleanout opening in the lower end of the tank. By incorporating the agitation system with the cleanout panel, the system can be readily retrofitted to existing water heaters without the necessity of drilling holes in the tank wall.

In a further embodiment of the invention, the circulating conduit that is connected to the inlet side of the pump, is mounted concentrically with the hot water outlet of the tank, so that both the circulating conduit and the hot water outlet extend through a single opening in the tank wall. Similarly, the circulating conduit that is connected to the discharge side of the pump is mounted concentrically with the water inlet pipe that supplies cold makeup water to the tank. This embodiment has the advantage that the circulating system is incorporated with the water inlet and outlet lines and no additional openings are required in the tank wall.

The pump can be operated continuously, or alternately, at various intervals through a timing mechanism, or in response to water draws from the tank.

As circulation of water through the agitation system can occur frequently or continuously, and independently of water draws from the tank, scale deposition on the lower head is minimized and the temperature of the heat transfer surface is reduced, resulting in improved water heating efficiency.

The invention provides more even heat distribution of water throughout the tank, thereby increasing the thermal storage capacity of the water heater. Thus, the tendency to "short cycle" is reduced, resulting in longer component life.

The agitation system also acts to prevent the stratification of heated water in the tank and thus prevents the water in the upper end of the tank from being overheated, which can occur if short intermittent draws of water are required. Because of this, more precise control of the outlet water temperature can be attained, particularly at temperature levels required for sanitizing purposes.

Other objects and advantages will appear in the course of the following description.

DESCRIPTION OF THE DRAWINGS

The drawings illustrate the best mode presently contemplated of carrying out the invention.

In the drawings:

FIG. 4 is a perspective view of a modified form of the invention;

FIG. 5 is a longitudinal section with parts broken away showing the hot water outlet pipe assembly of the water heater of FIG. 4; and FIG. 6 is an enlarged fragmentary view with parts broken away in section showing the cold water inlet assembly.

DESCRIPTION OF THE ILLUSTRATED EMBODIMENT

Figure 1:
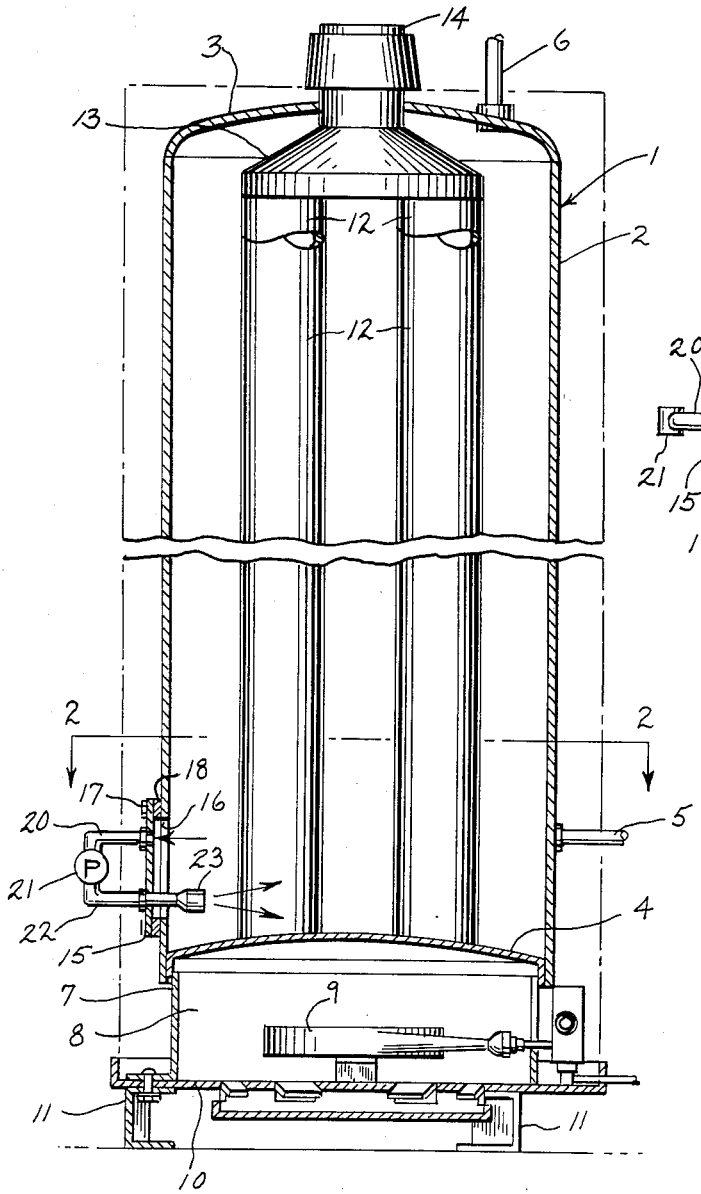
FIG. 1 is a vertical section of a water heater incorporating the agitation system of the invention.

FIG. 1 shows a commercial water heater including a tank 1 to contain water to be heated. Tank 1 is composed of a generally cylindrical shell 2 which is enclosed at its upper end by an upper head 3 and at its lower end by a lower head 4. Water is introduced into tank 1 through an inlet fitting 5 and is withdrawn from the upper end of the tank through an outlet 6.

Extending downwardly from the lower head is a cylindrical skirt 7 which defines a burner chamber 8. A gas-fired burner 9 is mounted within burner chamber 8 and serves to heat the water in tank 1.

The lower end of burner chamber 8 is closed by a plate 10 and a plurality of legs 11 extend downwardly from plate 10 and serve to support the water heater.

Tank 1 is enclosed by a layer of insulation, not shown. In some water heaters, the layer of insulation may take the form of a layer of foam plastic material, or alternately, a metal jacket may be mounted in spaced relation to tank 1 and a layer of insulation is located between the tank and the outer jacket.

The waste gases of combustion from operation of burner 8 are discharged through one or more of flues 12 which extend upwardly through tank 8. The upper ends of flues 12 are connected to a manifold 13 through which the gases are discharged to a stack 14 that communicates with the exterior.

Figure 2:
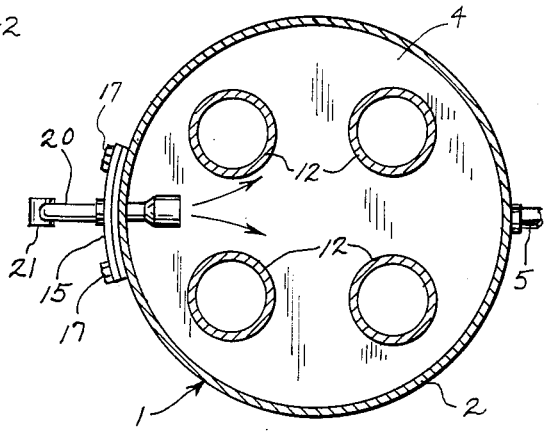
FIG. 2 is a section taken along line 2—2 of FIG. 2.

In accordance with the invention, a closed circulating system is employed to agitate the water in the lower end of tank 1. In the illustrated form of the invention, as shown in FIGS. 1 and 2, the circulation system is carried by a panel 15 which encloses a cleanout opening 16 in the lower end of tank 1. Panel 15 is connected to the tank by a plurality of bolts 17 and a gasket 18 seals the joint between the panel and the tank wall.

The circulating system is composed of a conduit or pipe 20 which is mounted within an opening in panel 15 and the outer end of the conduit 20 is connected to the inlet side of a pump 21. The discharge side of pump 21 is connected to one end of a second conduit 22 and the opposite end of conduit 22 is mounted within a second opening in panel 15. The inner end of conduit 22 extends into tank 1, so that the water will be discharged through the outlet end 23 in the form of a jet or high pressure stream. Outlet 23 is located adjacent the upper surface of lower head 4, so that the recirculating water will tend to agitate the water and sweep any sediment from the lower head.

Outlet 23 can take various configurations, such as a circular orifice, a fan-shaped aperture, or the like. In addition, the outlet 23 can be directed either horizontally or downwardly at an angle against the lower head 4.

Figure 3:
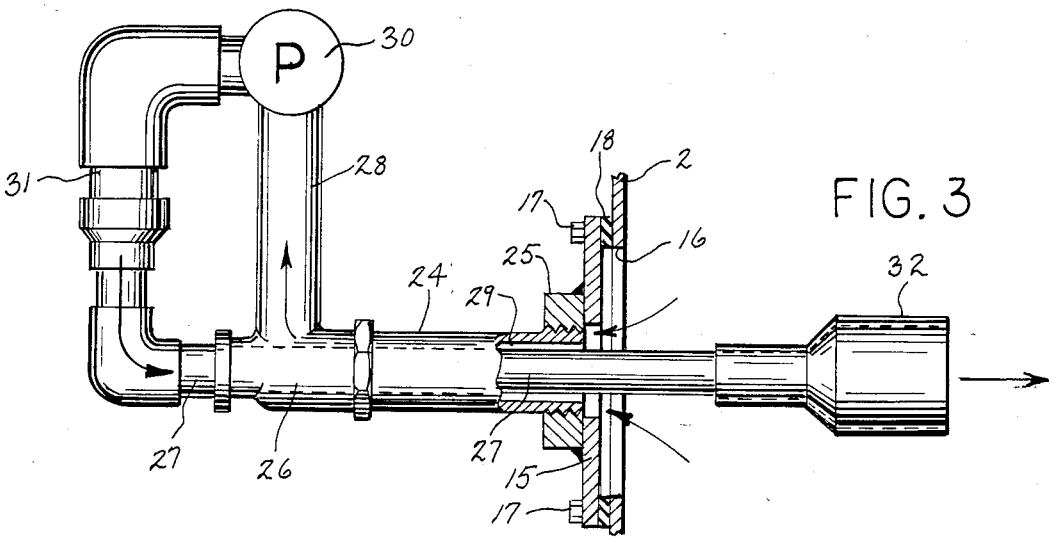
FIG. 3 is an enlarged fragmentary vertical section of a modified form of the invention.

FIG. 3 illustrates a modified form of the invention, in which the conduits of the circulating system are mounted in concentric relation so that both conduits are connected through a single opening.

In this embodiment, the circulating system includes an outer tube or conduit 24, which is threaded within an opening in spud 25 that is secured to panel 15 and the outer end of the conduit is connected to a fitting 26. A second conduit 27 is mounted concentrically within conduit 24 and extends outwardly beyond fitting 26. Vertical pipe 28 is connected to fitting 16 and provides communication between the annular space 29 between conduits 24 and 27 and the inlet side of pump 30, while a conduit 31 is connected between the outer end of conduit 27 and the discharge side of pump 30. Mounted on the inner end of conduit 27 is a discharge nozzle 32.

Operation of pump 30 will draw water from the tank through the annular space 29 between conduits 24 and 27 and then through pipe 28 to the pump. Water will be discharged through conduit 31 and pipe 27 for return to the tank. As in the case of the first embodiment, the discharge of water into the lower end of the tank will agitate the water and prevent the buildup of sediment on the lower head.

The agitation system has a further advantage in that it will aid in preventing stratification of the water. As water is drawn from the tank, cold water will be admitted into the lower end of the tank and the entry of cold water into the lower end of the tank will normally trigger the thermostat to start the burner. Frequent intermittent operation of the burner can cause the water in the upper end of the tank to stratify and become overheated. The circulating system of the invention prevents stratification by acting to circulate the water within the tank and provide a substantially uniform water temperature throughout the tank volume.

Pump 21 can be operated continuously or intermittently. Intermittent operation can be controlled manually or automatically by a suitable timing device or through controls actuated by incoming or outgoing water.

While the drawings have shown the circulating mechanism mounted on the cleanout panel, it is contemplated that the circulating system can be mounted separately from the panel. However, the incorporation of the circulating system with the panel has the advantage that the agitation system can be retrofitted to existing tanks merely by replacing the original cleanout panel with a panel incorporating the agitation system.

FIGS. 4–6 illustrate a modified form of the invention, in which the circulation system is associated with the water inlet and outlet pipes of the tank. As illustrated in FIG. 4, water heater 33 includes a tank 34, similar to tank 1 of the first embodiment, and tank 34 is enclosed by a jacket 35. A layer of insulating material 36 which can take the form of fiber glass or foam plastic material, is located in the space between tank 34 and jacket 35.

FIG. 5 illustrates the hot water outlet assembly and, as illustrated, an annular internally threaded spud 37 is welded to the outer surface of tank 34 and borders a opening in the tank wall. A nipple 38 is threaded with spud 37 and extends outwardly through an opening in jacket 35. The outer end of nipple 38 is secured within an opening in T-fitting 39, while a pipe or conduit 40 is secured within the stem opening of fitting 39 and is connected to the inlet or suction side of a pump 41.

Mounted concentrically within nipple 38 is a hot water outlet pipe 42. The inner end of pipe 42 is located within tank 34 and the opposite end of the pipe is connected to the water system of the building. On a demand for hot water caused by opening a faucet in the water system, hot water will withdrawn from the tank through pipe 42.

As shown in FIG. 4, a pipe or conduit 43 connects the discharge side of pump 41 with an opening in the stem portion of T-fitting 44. The outer end of a nipple 45 is secured within an opening in fitting 44, while the inner end of the nipple is threaded to an annular spud 46, which is welded to the outer surface of tank 34 bordering an opening in the tank wall.

A cold water inlet pipe 47 is mounted concentrically within nipple 45 and the outer end of the pipe extends from the fitting 44 and is connected to a suitable source of cold water. The inner end of inlet pipe 47 carries a nozzle 48.

On a demand for hot water, hot water from the upper end of tank 44 will be withdrawn through pipe 42 and simultaneously, fresh incoming cold water will be drawn into the tank through inlet pipe 47 and discharged through nozzle 48 across the lower head of the tank to agitate and disperse any scale that may have formed on the lower head.

The circulation system of FIGS. 4–6 can act independently of water draws and by operating the pump 41, either continuously or intermittently, heated water will be drawn from the upper end of tank 34 through nipple 38, fitting 39, conduit 40 to pump 41 and the water will be discharged by the pump through conduit 43, fitting 44, nipple 45 to the interior of the tank. The water passing through this circulation system will act to continuously disperse scale formed on the lower head of the tank, as well as cooling the lower head and providing more efficient heat transfer.

Moreover, the circulation of the water, which can be independent from water draws, reduces the propensity for stacking and provides more even heat distribution throughout the volume of the tank. Because of this, more precise control of outlet water temperatures can be achieved, which is particularly important at temperature levels required for sanitizing purposes.

While the construction shown in FIGS. 4–6 illustrates the water supply pipe 47 and hot water outlet pipe 42 being locked concentrically within the circulation conduits, it is contemplated that the arrangement can be reversed, in which one or both of circulation conduits can be mounted concentrically within, or in side-by-side relation to, the water inlet and outlet pipes.

Various modes of carrying out the invention are contemplated as being within the scope of the following claims particularly pointing out and distinctly claiming the subject matter which is regarded as the invention.

I claim:

1. A water heater, comprising a tank to contain water to be heated and having a pair of apertures, a first of said apertures being located in the upper portion of said tank and a second of said apertures being located in the lower portion of said tank, outlet conduit means for withdrawing heated water from the tank and disposed in said first aperture, inlet conduit means for introducing cold water to said tank and disposed within said second aperture, and water circulating means including a pump, a first line connecting the inlet side of the pump to the interior of said tank and disposed within said first aperture, and a second line connecting the discharge side of the pump to said interior of the tank and disposed within said second aperture, operation of said pump acting to withdraw water from said tank through said first line and discharge water through said second line into the lower end of the tank.

2. The water heater of claim 1, wherein said first line and said outlet conduit means are mounted concentrically within said first aperture and said inlet conduit means and said second line are mounted concentrically within said second aperture.

3. The water heater of claim 1, wherein said second tank has a lower head and said water heater includes gas fired heating means disposed beneath said lower head.

4. The water heater of claim 1, wherein said tank has a lower head and said second line has an outlet communicating with the interior of said tank, said outlet being constructed and arranged to discharge water across said lower head.

5. The water heater of claim 4, wherein said inlet conduit means has an outlet communicating with the interior of the tank, the outlet of said inlet conduit means being constructed and arranged to direct cold water across said lower head.

* * * * *

UNITED STATES PATENT AND TRADEMARK OFFICE

CERTIFICATE OF CORRECTION

PATENT NO. : 4,790,289

DATED : December 13, 1988

INVENTOR(S) : Fred E. Barrett

It is certified that error appears in the above-identified patent and that said Letters Patent is hereby corrected as shown below:

Column 6, line 20, Claim 3, cancel "second".

Signed and Sealed this

Twentieth Day of February, 1990

*Attest:*

JEFFREY M. SAMUELS

*Attesting Officer*

*Acting Commissioner of Patents and Trademarks*